US005503226A

United States Patent [19]

Wadleigh

[11] Patent Number: 5,503,226

[45] Date of Patent: Apr. 2, 1996

[54] PROCESS FOR RECOVERING HYDROCARBONS BY THERMALLY ASSISTED GRAVITY SEGREGATION

[76] Inventor: Eugene E. Wadleigh, 1715 Princeton, Midland, Tex. 79701

[21] Appl. No.: 499,074

[22] Filed: Jul. 6, 1995

Related U.S. Application Data

[63] Continuation of Ser. No. 263,629, Jun. 22, 1994, abandoned.

[51] Int. Cl.[6] ..... E21B 43/24; E21B 43/30; E21B 47/04

[52] U.S. Cl. ..... 166/252.1; 166/50; 166/245; 166/272; 166/303; 166/306

[58] Field of Search ..... 166/50, 245, 250, 166/252, 272, 303, 306

[56] References Cited

U.S. PATENT DOCUMENTS

| | | | |
|---|---|---|---|
| 2,404,341 | 7/1946 | Zublin | 166/306 |
| 2,936,030 | 5/1960 | Allen | 166/306 |
| 3,342,259 | 9/1967 | Powell | 166/272 |
| 3,412,794 | 11/1968 | Craighead | 166/272 |
| 3,653,438 | 4/1972 | Wagner | 166/306 X |
| 3,872,924 | 3/1975 | Clampitt | 166/272 X |
| 3,983,939 | 10/1976 | Brown et al. | 166/272 X |
| 4,040,483 | 8/1977 | Offeringa | 166/303 |
| 4,042,029 | 8/1977 | Offeringa | 166/306 |
| 4,327,805 | 5/1982 | Poston | 166/272 |
| 4,344,485 | 8/1982 | Butler | 166/272 X |
| 4,687,057 | 8/1987 | Moore et al. | 166/272 X |
| 4,766,958 | 8/1988 | Faecke | 166/272 X |
| 4,986,352 | 1/1991 | Alameddine | 166/245 X |
| 5,036,917 | 8/1991 | Jennings, Jr. et al. | 166/272 X |
| 5,036,918 | 8/1991 | Jennings, Jr. et al. | 166/272 X |

OTHER PUBLICATIONS

J. N. M. van Wunnik et al., "Improvement of Gravity Drainage by Steam Injection Into a Fissured Reservoir: An Analytical Evaluation," SPE/DOE 20251, presented at SPE/DOE Seventh Symposium on Enhanced Oil Recovery, Tulsa, OK, Apr. 22–25, 1990, pp. 763–772.

*Primary Examiner*—George A. Suchfield
*Attorney, Agent, or Firm*—Jack L. Hummel; Jack E. Ebel

[57] ABSTRACT

A process for recovering hydrocarbons from a subterranean formation having low permeability matrix blocks separated by a well-connected fracture network. Hot light gas is injected into the formation to heat the matrix blocks and create or enlarge a gas cap in the fracture network. The flowing pressure in one or more production wells is maintained at a value slightly less than the free gas pressure at the gas liquid interface, causing gas coning near the production well or wells. Both liquid and gas are recovered from below the gas/liquid interface in the fractures.

51 Claims, 5 Drawing Sheets

PROCESS FOR RECOVERING HYDROCARBONS BY THERMALLY ASSISTED GRAVITY SEGREGATION

CROSS REFERENCE TO RELATED APPLICATION

This application is a continuation of U.S. patent application, Ser. No. 08/263,629, filed on Jun. 22, 1994, now abandoned.

BACKGROUND OF THE INVENTION

1. Field of the Invention

This invention relates generally to a process for recovering hydrocarbons from a subterranean formation having heterogeneous permeability, and in particular to a process for recovering hydrocarbons containing one or more volatile components from a heterogeneous subterranean formation 2. Description of Related Art Most enhanced oil recovery processes were designed for use in subterranean formations having homogeneous permeability. These processes generally emphasize horizontal migration of fluids while maintaining horizontal fluid layers, commonly referred to as flow units, in the formation. In designing such processes, coning, or deflection of fluid interfaces, such as gas/oil or oil/water contacts, near production wells, has been viewed as a problem to be avoided. In accordance with one type of process, a gas, such as $CO_2$, is injected into a subterranean formation and is dissolved in oil present therein to increase the oil volume and decrease the oil viscosity. Injected gas also is believed to replace oil in the formation matrix via a gravity drainage mechanism. Another type of enhanced recovery process involves heating the oil, thereby increasing the oil volume and decreasing the viscosity thereof. Thermal oil recovery processes have been used primarily, but not exclusively, with heavy oil which contains a very small fraction of volatile components. In some thermal recovery processes, distillation of volatile oil components is believed to contribute significantly to oil mobilization. Most thermal recovery processes have been conducted in relatively. unconsolidated sandstone formations. In another type of enhanced recovery process, the surface tension of the oil present in a subterranean formation is altered by flooding the formation with a surfactant, thereby promoting replacement of the oil in the formation matrix by the surfactant. In addition to increasing the quantity of oil recovered, these enhanced recovery processes, used singularly or in combination, may increase the rate of fluid movement from the formation matrix by a factor of about ten.

Enhanced oil recovery processes are generally ;less effective in formations with heterogeneous permeability distributions as, for example, in a highly fractured formation in which most of the oil is located in low-permeability matrix blocks which are surrounded by a high-permeability connected fracture network. It is generally believed that in such a heterogeneous formation, capillary forces trap a significant portion of the oil present in the low permeability blocks and inhibit oil production. Often, techniques have been employed to attempt to make the heterogeneous formation behave in a more homogeneous manner, rather than employing a process which takes advantage of the qualities of the heterogeneous formation.

U.S. Pat. Nos. 4,040,483 and 4,042,029 to J. Offeringa and SPE/DOE paper 20251 by J. N. M. van Wunnik and K. Wit describe processes in which a gas cap is created at the top of a heterogeneous-permeability formation to isolate oil bearing matrix blocks. Hot or cool gas is then injected into the reservoir to decrease the oil viscosity and increase the oil volume. Oil is also gravity replaced by gas that comes out of solution. All of these processes are believed to involve relatively slow gravity drainage of oil and focus upon overcoming Capillary forces to accelerate gravity drainage of liquid.

Thus, there is a need for a process that increases the quantity of relatively light, volatile liquid and gaseous hydrocarbon which can be recovered from a subterranean formation having heterogeneous permeability. An additional need is for a process to produce fluid from subterranean formations more rapidly.

Accordingly, a primary object of the present invention is to produce increased quantities of volatile fluid from a subterranean formation having heterogeneous permeability.

A further object of the present invention is to produce the fluid more rapidly.

SUMMARY OF THE INVENTION

To achieve the foregoing and other objects, and in accordance with the purposes of the present invention, as embodied and broadly described herein, one characterization of the present invention comprises a process for producing oil and gas from a subterranean hydrocarbon-bearing formation having at least one high permeability region and at least one low permeability region. The at least one low permeability region contains oil having volatile components. Initially, the at least one high permeability region has a gas-filled upper portion, a liquid-filled lower portion, and a gas/liquid interface. A hot light gas is injected into the formation via at least one injection well in fluid contact with the formation, thereby heating at least the upper portion of the formation. Liquid and gas are produced from below the gas/liquid interface via at least one production well in fluid communication with the formation at a rate sufficient to cause gas to cone near the at least one production well. In another characterization of the present invention, the high permeability regions in the formation are initially liquid-filled, and a light gas is injected via the at least one injection well to form a gas cap and a gas/liquid interface within the high permeability regions in the upper portion of the formation. The hot light gas may be used to form a gas cap. In yet another characterization, the high permeability regions of the formation are initially liquid-filled, and the formation pressure is decreased to create a gas cap and a gas/liquid interface within the high permeability regions in the upper portion of the formation.

BRIEF DESCRIPTION OF THE DRAWING

These and other features, aspects, and advantages of the present invention will become better understood with reference to the following description, appended claims, and accompanying drawings where:

DETAILED DESCRIPTION OF THE PREFERRED EMBODIMENTS

Figure 2:
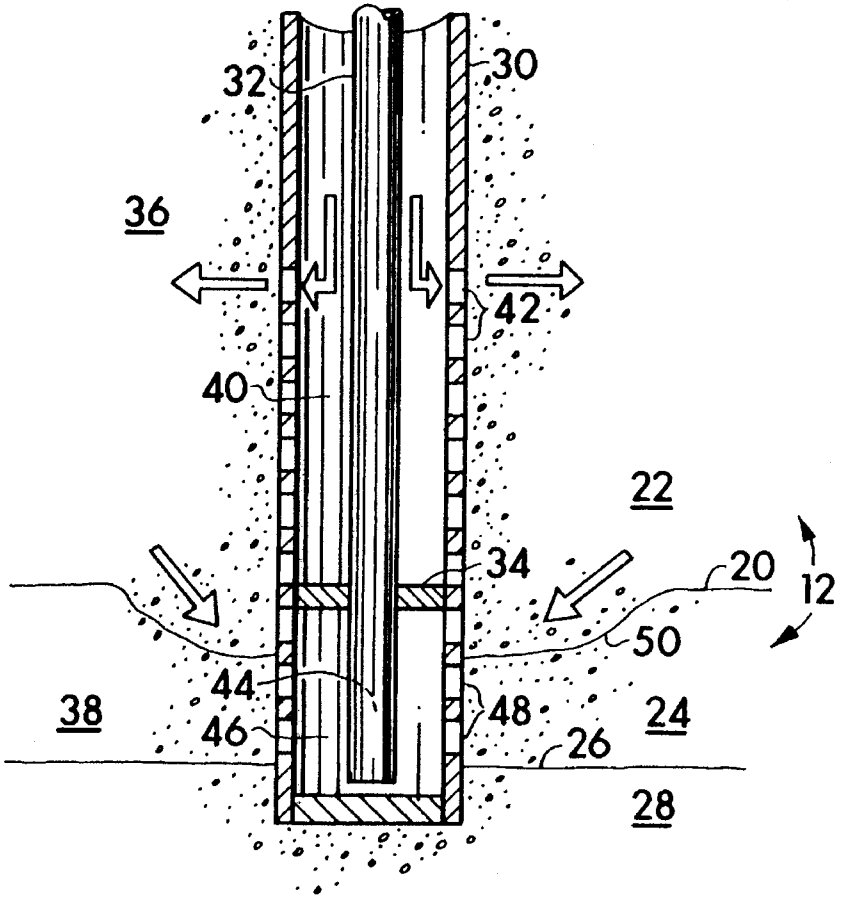
FIG. 2 is a cross sectional view of a common injection and production well penetrating a subterranean formation.

The process of this invention is most applicable to the recovery of hydrocarbons from a subterranean hydrocarbon formation;having a porous matrix and a heterogeneous permeability distribution. The fluid in the high permeability regions in the upper portion of the formation substantially comprises gas, and the fluid in the high permeability regions in the lower portion of the formation comprises liquid hydrocarbons. The fluids are separated within the high permeability regions by a substantially horizontal gas/liquid interface. At least one injection well and at least one production well penetrate and are in fluid communication with the formation. Hot gas is injected via the injection well into at least the upper portion of the formation to heat the matrix and mobilize volatile hydrocarbons within the matrix by steam distillation or vaporization. The mobilized volatile hydrocarbons enter the high permeability regions adjacent the matrix blocks and are produced therefrom as liquid and/or gas.

The formation may comprise low permeability matrix blocks separated by an extensive fracture network. Preferably, the fractures are naturally occurring, although the process could work with extensively interconnected artificially induced fractures. In most fractured subterranean formations, a primary set of fractures is oriented approximately vertically and approximately perpendicular to the minimum stress direction. Secondary fractures may interconnect the primary fractures.

In one embodiment of the present invention, the formation matrix contains pores at least partly filled with liquid comprised substantially of hydrocarbons with a significant volatile component. Either liquid, gas, or a combination of liquid and gas fills the fractures. The liquid in the matrix pores or the fractures may also comprise water. The pore system within the matrix may be "tortuous", with about one or a limited number of throats or connections between the pores. Tortuous porosity occurs in well-cemented clastic formations and in carbonates with moldic porosity. Moldic porosity occurs when portions of the matrix have been dissolved, leaving partially or totally isolated voids or pores in place of the dissolved portions. Within a tortuous pore system, fluid passage into or out of a pore may be limited mechanically. Thus, viscous forces may not control the flow of oil into or out of the low permeability matrix blocks, thereby limiting the effectiveness of enhanced recovery methods relying on viscous forces for fluid displacement.

Although the process of this invention could be applied to other types of reservoirs, it may not be economically viable to do so. Because prior art techniques are inefficient at recovering oil from tortuous porosity, the economic benefits of the present invention are potentially higher for fractural reservoirs in which the matrix blocks have tortuous porosity.

In another embodiment of the present invention, the fluid in the fracture network in the upper portion of the formation initially comprises oil, water, or a mixture thereof. A gas cap is created in the fracture network, either by reducing the formation pressure to permit gas to evolve out of solution or, preferably, by injecting a first light gas via at least one injection well in fluid communication with the formation. The first light gas may comprise steam, $N_2$, methane, ethane, produced residue gas, flue gas, $CO_2$ or mixtures thereof. Preferably, the gas has a low molecular weight. $CO_2$ is less desirable because of its relatively high molecular weight and because it may react with carbonate cement in clastic formations, thereby increasing the formation friability and the likelihood of sand production. The low permeability matrix blocks adjacent the gas-filled fractures contain liquid.

A second, hot, light gas is injected via the at least one injection well into the formation to vaporize components of the oil present in formation matrix blocks as discussed below. The second light gas may comprise steam, $N_2$, methane, ethane, produced residue gas, flue gas, $CO_2$, or mixtures thereof. As with the first light gas, $CO_2$ is less desirable. The gas may be injected into the upper portion of the formation only, where the fractures are gas filled, or it may be injected into the, upper and lower portions. To avoid undesirable in situ formation of steam and limit excessive heat loss to an aquifer that may be present, the gas should not be injected into water-filled fractures in the lower portion of the formation.

Figure 1:
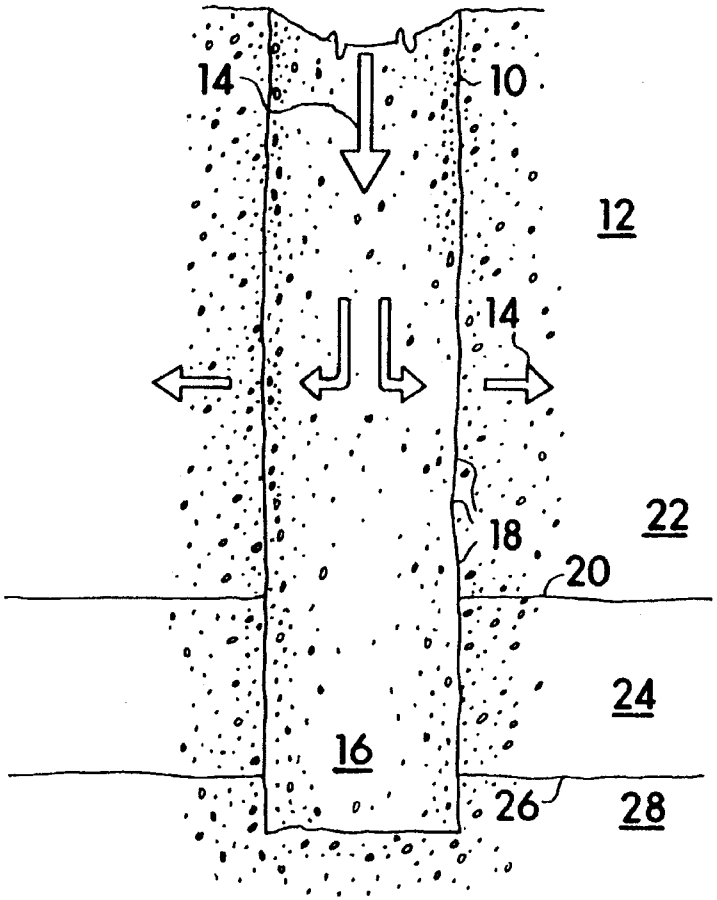
FIG. 1 is a cross sectional view of an injection well penetrating a subterranean formation.

As illustrated in FIG. 1, an injection well 10 penetrates a fractured subterranean hydrocarbon reservoir 12. The second light gas 14 is injected into the upper portion of the reservoir 12 via well bore 16 and perforations 18. A horizontal gas/oil interface 20 separates gas and oil layers 22 and 24 in the fractures, and a horizontal oil/water interface 26 separates oil and water layers 24 and 28.

Injection of the second light gas (not illustrated) may be performed concurrently with injection of the first gas, or the gases may be combined in a single injection. The gases may have either the same composition or different compositions, depending on the requirements of the specific application of the process. Both gases may be injected via the same well or wells, or each gas may be injected via one or more separate wells. Each injection well 10 can be completed by any method known to those skilled in the art. Preferably, each injection well 10 has been completed in at least the upper portion of the formation.

As is apparent to one skilled in the art, the optimum temperature and pressure of the injected gas depend upon the PVT properties of the liquid and gas in the formation and upon the chemical and mechanical properties of the formation matrix. The second gas can be heated by any method, either at the surface, in the wellbore, or in the formation. The first gas may also be heated. For reasons of economy and efficiency, it is preferred that the second gas or both gases be heated using a downhole burner within the wellbore. Preferably, the temperature of the injected gas should be more than about 400° F., but less than the temperature at which the matrix will break down. For example, dolomite can withstand temperatures up to about 1100° F. If an aquifer is present at the bottom of the formation, the gas cap pressure must be great enough to prevent water from encroaching into the fractures in the upper portion of the reservoir. Preferably, the gas cap pressure is great enough to push water out of a portion of the fractures. However, the pressure must be less than that which would force gas or oil into the aquifer.

The fracture network serves as a conduit for the hot injected gas, allowing the gas to spread rapidly through the formation and heat the liquid in the matrix blocks via thermal conduction. The gas flow direction is parallel to the primary fracture set orientation, forming an elongated zone of hot light gas. A volatile component of the liquid within the matrix blocks is vaporized to form a heavy gas comprised of one or more volatile hydrocarbons other than methane or ethane, such as propane, butane, pentane, and longer chain components typically referred to as natural gasolines or condensates. The heavy hydrocarbon gas then escapes from the matrix blocks into the fracture network. It is believed that within the fractures, a convective flow draws hot light gas upward while dense, cooler hydrocarbon vapors distilled from the matrix segregate downward. The heavy gas settles and may condense above the gas/liquid interface in the fractures. The heavy gas and/or condensate may also dissolve into additional oil from adjacent matrix blocks. Some of the condensate may imbibe into the matrix blocks. In either case, the condensate acts as a solvent, reducing the oil viscosity and imparting its heat loss due to condensation into this liquid phase.

Vaporization of the volatile oil components and segregation of the gas phase in fractures are believed to occur significantly faster than gravity drainage of liquids from the matrix blocks. Thus, gravity drainage of liquid from the matrix blocks is also believed to contribute to liquid production. It is speculated that, unlike prior art processes utilized in liquid-rich systems, thermal expansion of the oil does not contribute significantly to oil production when the oil saturation in the matrix blocks is low. When oil saturation is low and gas saturation is high, the oil cannot swell sufficiently to fill the pore spaces and drain from the matrix. Depending upon the oil composition, the oil may shrink as the volatile portion is vaporized. The process of this invention relies on the belief that fluid segregation is a predominantly vertically phenomenon. In contrast, most prior art enhanced recovery processes were designed with an assumption that fluid movement is primarily horizontal.

In the present invention, liquid and heavy gas are produced via at least one production well in fluid communication with the formation. Each well may be completed using any method known to those skilled in the art. Preferably, each production well has been completed over an interval sufficient to accommodate a gradual shift over time in the level at which fluids are produced. The well flowing pressure below the gas/liquid interface is maintained at a value slightly less than the gas cap pressure, causing a local deflection, or "cone," of the gas/liquid interface near the well. Coning results in production of heavy gas along with liquid.

It is preferred that the at least one injection well be separate and distinct from the at least one production well to minimize production of the second light gas. However, with appropriate completion, a single well 30 may serve as both an injection well and a production well, as shown in FIG. 2, penetrating the same reservoir 12 illustrated in FIG. 1. Well 30 may be completed open hole or with a casing, not shown. A production tubing string 32 is installed within the well 30. Preferably, production tubing string 32 is set with the bottom of the tubing just above the bottom of the well. Any suitable means, such as one or more packers 34 are installed to isolate the gas injection zone 36 in the upper portion of the reservoir from the liquid and gas production zone 38 in the lower portion of reservoir. Gas injection into the gas injection zone 36 can be accomplished above packer 34 via an upper annulus 40 between tubing string 32 and the well bore face or casing and injection perforations 42. Fluid production can occur below packer 34 via the interior 44 of tubing string 32, lower annulus 46 between the tubing string 32 and the well bore face or casing, and production perforations 48. Alternatively, the liquid and gas production zone 38 could be an open hole completion. As fluid is produced, a cone 50 forms in the gas/oil interface 20 near well 30, permitting heavy gas and/or condensate to be produced together with liquid.

Figure 3A:
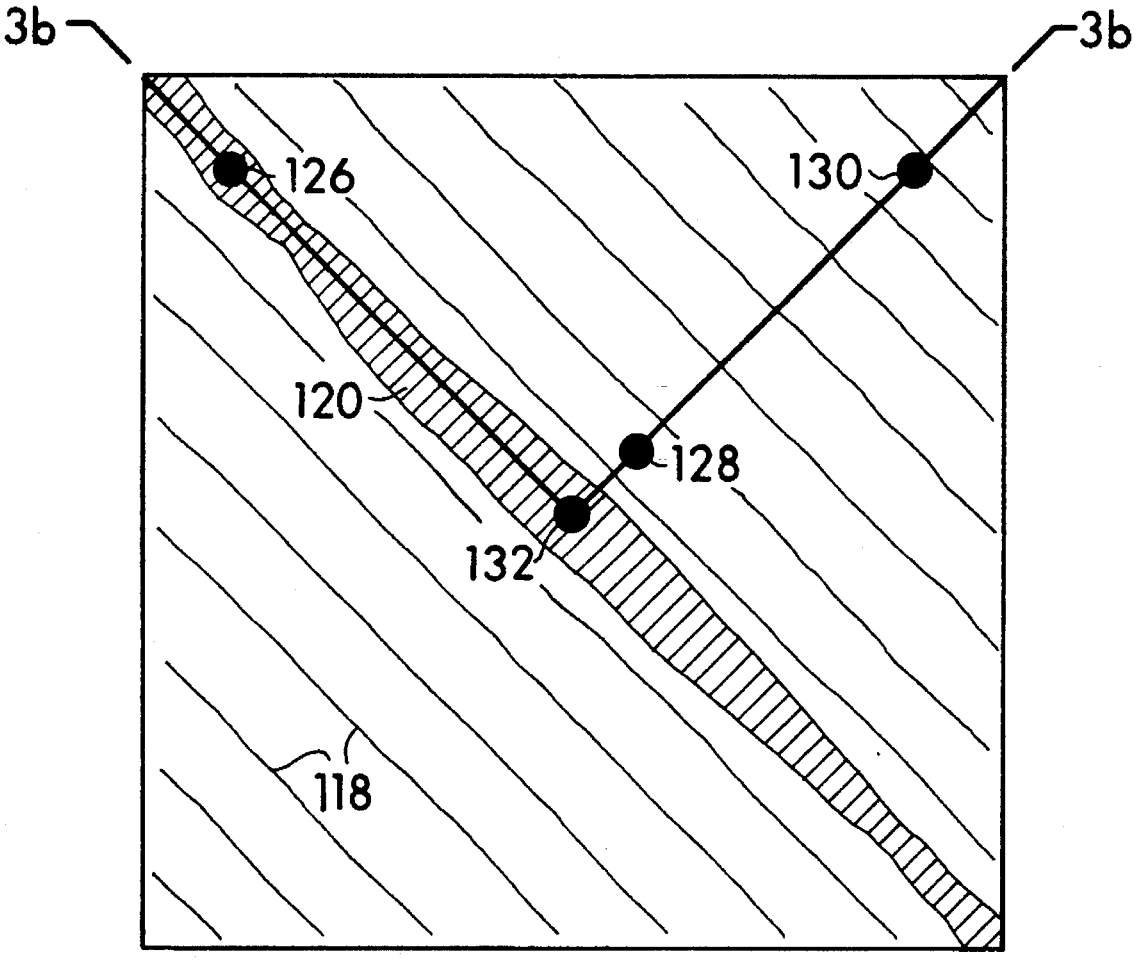
FIG. 3*a* is a map of a part of a fractured subterranean reservoir penetrated by an injection well and three production wells.

Alternatively, separate injection and production wells can be located and completed to optimize production of heavy gas and liquid. As illustrated in FIG. 3*a*, well 132 is an injection well, and wells 126, 128, and 130 are production wells. The hatch marks indicate the primary fracture orientation. Fracture 120, intersected by injection well 132, is poorly connected to approximately parallel fractures 118.

Figure 3B:
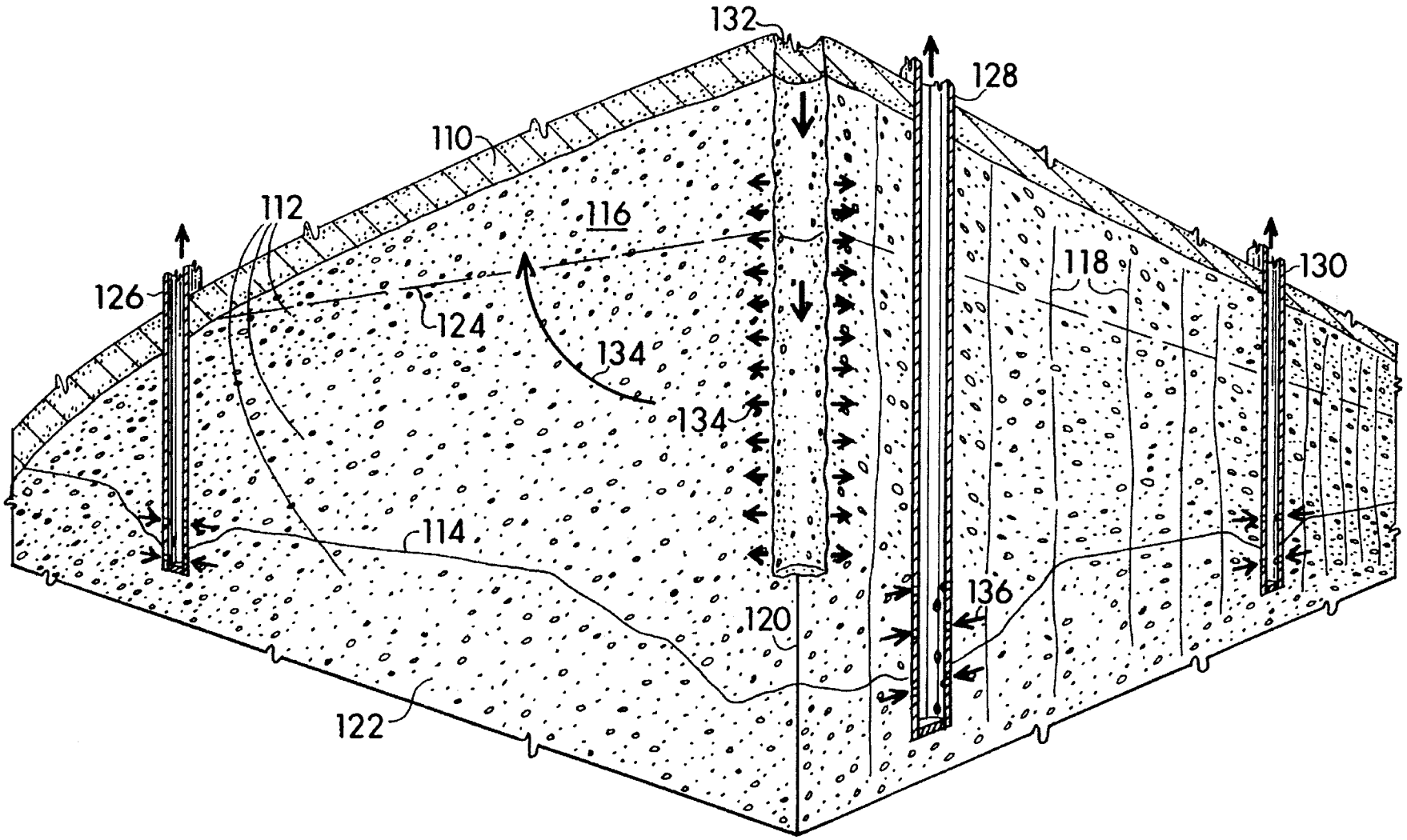
FIG. 3*b* is a block diagram showing the reservoir and wells of FIG. 3*a* in which the left side of the reservoir has been cut parallel to the primary fracture orientation direction, while the right portion has been cut perpendicular to the primary fracture orientation direction; a geological structure, shown on the left side of FIG. 3, dips away-from the viewer in a direction approximately parallel to the primary fracture orientation direction.

A fluid impermeable seal 110 overlies a fractured reservoir 112 (FIG. 3*b*). A gas/liquid interface 114 separates a gas cap 116, within the fractures 118 and 120 in the upper portion of reservoir 112, and liquid 122, within the fractures in the lower portion of the reservoir. A less distinct light/heavy gas interface 124 within gas cap 116 separates light gas at the top of the structure and heavy gas below the light gas. Both interfaces 114 and 124 are substantially horizontal except near wells 126, 128, and 130. The dipping subterranean structure truncates light/heavy gas interface 124 and gas/liquid interface 114 near the left edge of FIG. 3*b*. Injection well 132 has been completed in the gas cap 116. Hot light gas 134 is injected into the formation fracture network. Fracture 120 forms a conduit for the injected gas 134. Production well 126 has been completed below the level of the gas/liquid interface 114. Production well 126 is structurally lower and penetrates gas cap 116 below light/heavy gas interface 124. Hot light gas is injected via injection well 132, and heavy gas and liquid are produced via production well 126. Fluid flow directions are indicated by arrows.

As shown on the right side of FIG. 3*b*, injection well 132 intersects fracture 120, and production wells 128 and 130 intersect different fractures 118. If the fracture network is highly connected but not uniform, hot light gas 134 injected via injection well 132 may flow though only a portion of the fractures 118. The thermal gradient and the pressure of the injected gas may drive the heavy gas 136 into separate fractures. In this situation, production of heavy gas is facilitated by offsetting production wells 128 and 130 which are in fluid communication with fractures which are essentially parallel to the direction of the primary fracture orientation, as shown. Heavy gas and liquid are produced via production wells 128 and 130. Arrows indicate fluid flow directions.

Figure 4:
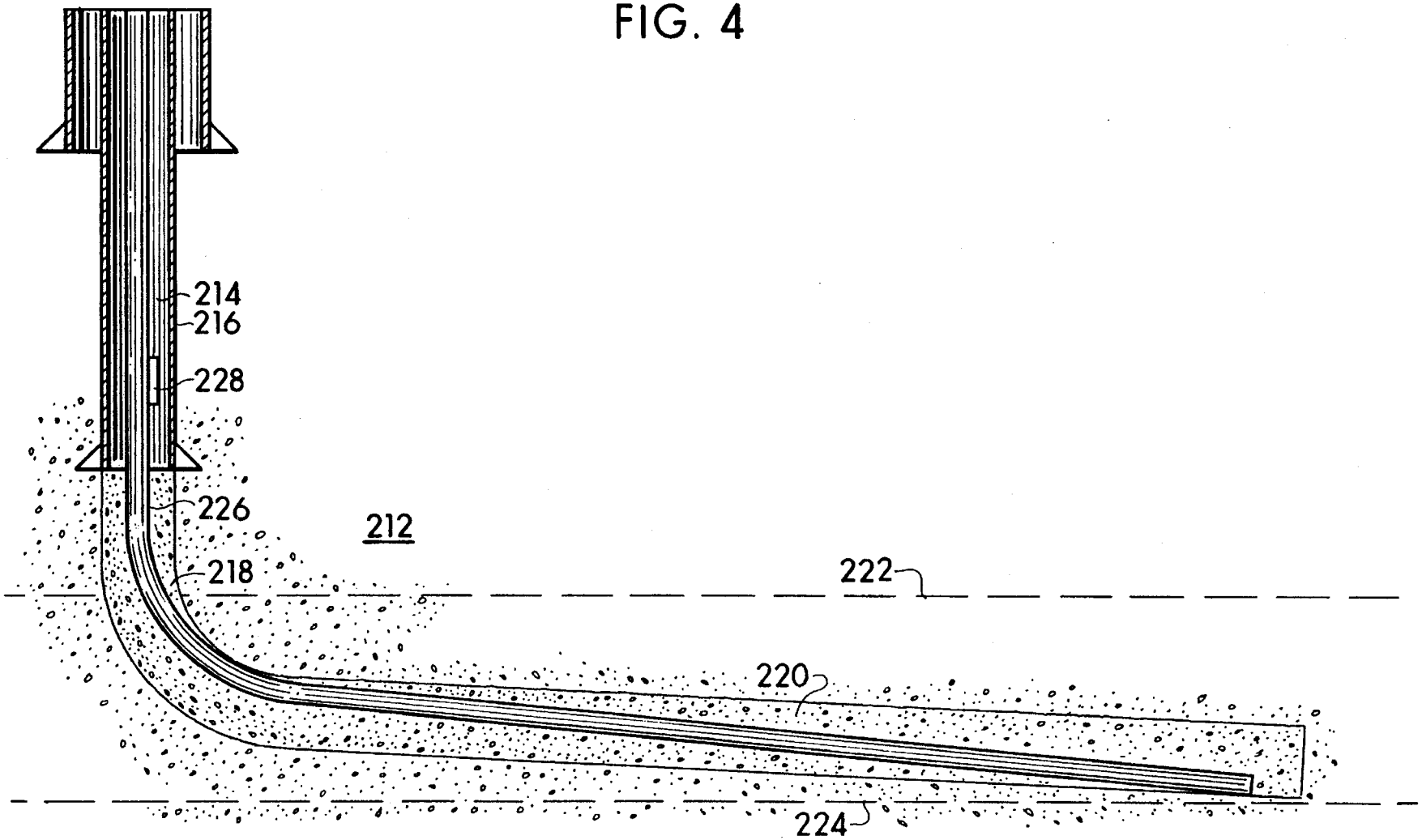
FIG. 4 is cross sectional view of a partially horizontal well penetrating a subterranean formation.

The injection or production well could be a horizontal well. FIG. 4 illustrates a fractured reservoir 212 penetrated by a production well having an approximately vertical upper portion 214, in which casing 216 has been installed, a radius section 218, and an approximately horizontal section 220. Radius section 218 and horizontal section 220 have been completed open hole. A gas/oil contact 222 is above horizontal section 220 and an oil/water contact 224 is below the horizontal section. Within the well, a tubing string 226 with gas lift mandrel 228 has been installed. The tubing string 226 is in fluid communication with radius section 218 and horizontal section 220 at the lowest point of the open hole section, shown in FIG. 4 at the end of the tubing. The lowest point could, however, be anywhere along horizontal section 220. Horizontal section 220 acts as a conduit for fluids flowing from the reservoir 212. Gas lift mandrel 228 is equipped with a small orifice to assist in initiating flow out of the well 214, 218, and 220. Mandrel 228 will allow only a small amount of gas to enter the tubing after flow is established and the pressure drop across the orifice is reduced.

Figure 5:
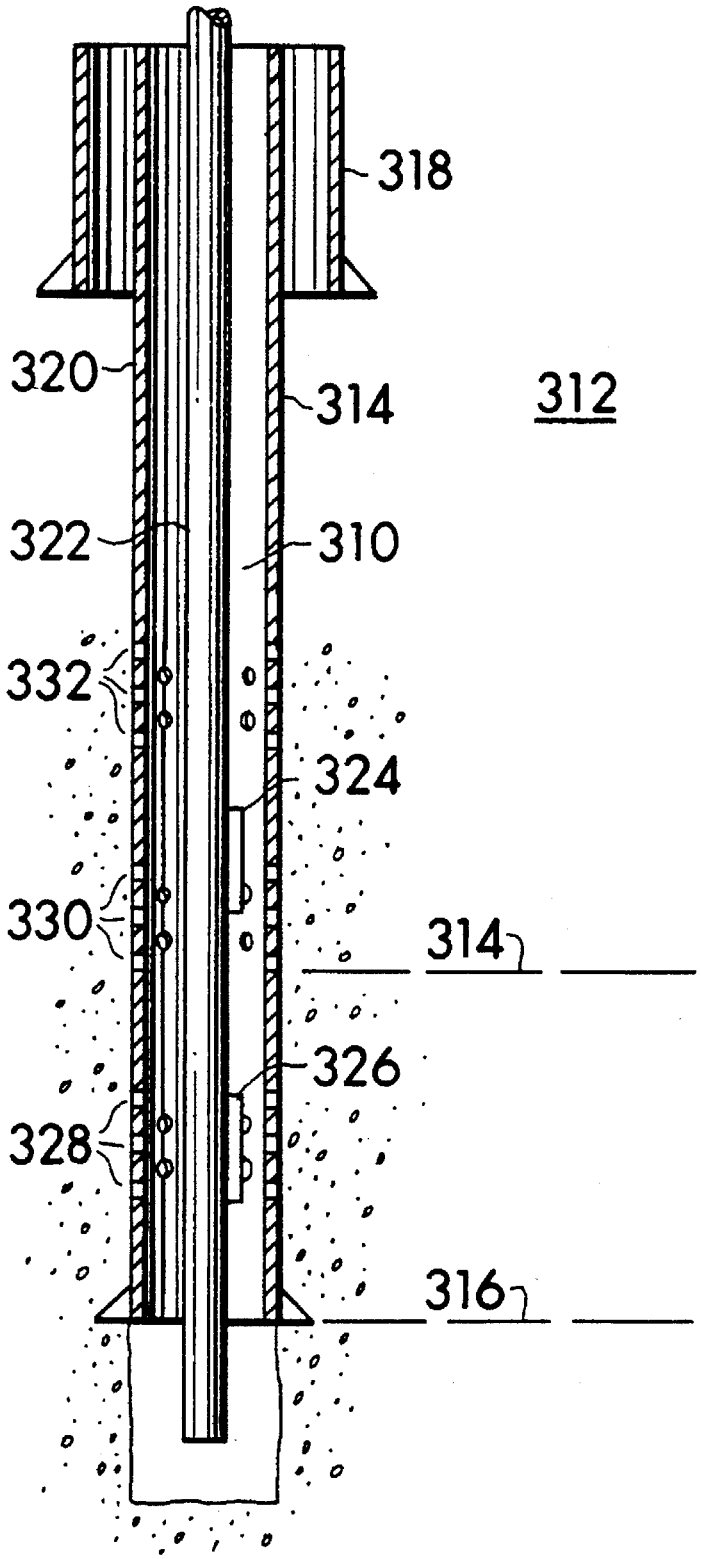
FIG. 5 is a cross sectional view of a cased production well penetrating a subterranean formation.

As is apparent to those skilled in the art, the level of the gas/liquid interface in the fractures, away from the at least one production well, will probably change over time. FIG. 5 illustrates one method of completing a production well to accommodate changes in the gas/liquid interface level. Well 310 penetrates fractured reservoir 312 having a gas/oil interface 314 and an oil/water interface 316. Well 310 is equipped with surface casing 318, production casing 320, and tubing string 322. Tubing string 322 extends below the level of oil/water interface 316 to a depth just above the bottom of well 310. Tubing string 322 is open for fluid entry at its lower end. Gas assist mandrels 324 and 326 contain gas flow orifices and are mounted on tubing string 322. Production casing 320 is perforated at 328, 330, and 332 so as to provide for production from a range of vertical zones. Initially, well 310 is not flowing. Gas from above gas/oil interface 316 flows through the orifice in gas assist mandrel 324 to provide gas assistance for initiating fluid flow to the surface via well 310. If the gas/oil interface level were lower than gas assist mandrel 326, both gas assist mandrels 324 and 326 would provide gas assistance. As fluid flows into the end of tubing string 322, the flowing pressure at the tubing entry increases. As the flowing pressure at the tubing entry increases, significant additional gas entry via mandrel(s) 324 and/or 326 into tubing string 322 is prevented. The drawdown pressure is maintained at a value approximately equal to or slightly less than the gas pressure in the fractures at gas/oil interface 314, thereby inducing coning as fluid flows into well 310 via perforations 328, 330, and 332.

Alternatively, the interface level can be monitored. As the interface level changes, the vertical production zone can be moved vertically to a more suitable position. Thus, it is desirable to complete the production well over a long enough interval to accommodate the changing interface level without requiring expensive plugging and recompletion operations. Moveable packers can be set to isolate the zone over which production is desired at any given time. Alternatively, the rate of hot gas injection or the rate of gas and liquid production can be altered to maintain the gas/liquid interface at a predetermined level.

The interface level can be determined using pressure measurements and fluid levels obtained in one or more observation wells located near the production well or wells. Alternatively or in addition, the composition of the produced fluids and fluid pressure in the production well adjacent the liquid filled fractures can be ascertained periodically with increased pressure drawdown. Increasing the drawdown allows verification that the gas produced at the surface is produced as gas from the formation, and not gas that has come out of solution within the wellbore. Also, analysis of gas composition variations with increased drawdown facilitates determining when the ratio of gas to liquid or the ratio of light gas to heavy gas reaches an economic or hardware-defined limit. Fluid pressures may be measured with a pressure bomb or other device located within the production well adjacent the production zone.

The following example demonstrates the practice and utility of the present invention but is not to be construed as limiting the scope thereof.

EXAMPLE

Tests are conducted in a horizontal well, such as the one illustrated in FIG. 4, penetrating a fractured subterranean reservoir. The well and test data are presented in Table I. The gas/oil and oil/water contact depths and the gas cap pressure are estimated, based on data from nearby offset wells.

Based on the test data, it is determined that the gas phase drawdown is insufficient to cause significant heavy gas coning. The choke is adjusted to 44/64 and the drawdown is increased by about 3 psi to increase the gas production rate about 50% while increasing the liquid production rate only about 12%.

TABLE I

| Bottom hole Pressure at tubing entry | |
|---|---|
| Static | 504 psig |
| Flowing | 478 psig |
| Pressure gradient in tubing tail | .35 psi/ft |
| Gas cap pressure | 483 psig |
| Ground Level | 2565 ft. above sea level |
| Top of horizontal | 1480 ft. true vertical depth |
| Bottom of horizontal | 1490 ft. true vertical depth |
| Gas/oil contact | 1434 ft. |
| Oil/water contact | 1505 ft. |
| Choke | 40/64 |
| Barrels oil/day | 101.0 |
| Barrels water/day | 1032.0 |
| MCF gas/day | 100.90 |
| Produced gas/oil ratio | 999 $ft^3$/barrel |
| Reservoir gas/oil ratio | 100 $ft^3$/barrel |
| Phase drawdown, average: | |
| Gas | 5.45 psig |
| Oil | 26.72 psig |
| Water | 25.51 psig |
| Normalized PI | 7.76 barrels/day/psi |

Thus, the process of the present invention improves the quantity and rate at which relatively light, volatile liquid and gaseous hydrocarbons can be recovered from a subterranean formation having heterogeneous permeability. While the foregoing preferred embodiments of the invention have been described and shown, it is understood that the alternatives and modifications, such as those suggested and others, may be made thereto and fall within the scope of the invention.

I claim:

1. A process for recovering hydrocarbons from a subterranean hydrocarbon-bearing formation, the formation having at least one high permeability region and at least one low permeability region, the low permeability region containing liquid hydrocarbons having volatile components and the high permeability region having a gas-filled upper portion, a liquid-filled lower portion, and a gas/liquid interface, the process comprising:

injecting a hot light gas into the formation via at least one injection well in fluid communication with the formation, thereby heating at least the upper portion of the formation; and producing liquid and gas via at least one production well in fluid communication with the formation, the liquid and gas produced from below the gas/liquid interface at a rate sufficient to cause gas to cone near the at least one production well.

2. The process of claim 1 wherein said light gas is selected from the group consisting of steam, produced residue gas, flue gas, $CO_2$, $N_2$, and mixtures thereof.

3. The process of claim 1 wherein said heat is provided at a temperature between about 400° F. and about 1100° F.

4. The process of claim 1 wherein said high permeability regions comprise a fracture network.

5. The process of claim 1 wherein said at least one injection well and said at least one production well are a common well.

6. The process of claim 1 wherein said produced gas comprises at least a portion of said volatile component of said liquid hydrocarbons in said matrix blocks.

7. The process of claim 1 wherein a production tubing string is positioned in said at least one production well so as to allow production from a vertical zone below said gas/liquid interface.

8. The process of claim 7 wherein said process additionally comprises monitoring said gas/liquid interface to determine changes in the depth of said interface.

9. The process of claim 8 wherein the depth of said vertical zone is adjusted in response to changes in the depth of said interface.

10. The process of claim 8 wherein said depth of said interface is adjusted by changing the rate at which said hot gas is injected into said formation.

11. The process of claim 8 wherein said depth of said interface is adjusted by changing the rate at which said liquid and gas are produced.

12. The process of claim 1 wherein said at least one high permeability region comprises a fracture network, and said at least one low permeability region comprises matrix.

13. A process for recovering hydrocarbons from a subterranean hydrocarbon-bearing formation, the formation having at least one high permeability region and at least one low permeability region, the low permeability region and the high permeability region containing liquid hydrocarbons having a substantial fraction of volatile components, the process comprising:

injecting a first light gas via at least one injection well in fluid communication with the formation, thereby forming a gas cap and a gas/liquid interface within the high permeability regions in the upper portion of the formation;

injecting a second, hot, light gas via the at least one injection well into the formation, thereby heating at least the upper portion of the formation; and producing liquid and gas via at least one production well in fluid communication with the formation, the liquid and gas produced from below the gas/liquid interface via at least one production well penetrating the formation, the liquid and gas produced at a rate sufficient to cause gas to cone near the at least one production well.

14. The process of claim 13 wherein said first light gas is selected from the group consisting of $N_2$, methane, ethane, produced residue gas, flue gas, $CO_2$, and mixtures thereof.

15. The process of claim 13 wherein said second light gas is selected from the group consisting of steam, produced residue gas, flue gas, $CO_2$, $N_2$, and mixtures thereof.

16. The process of claim 13 wherein said heat is provided at a temperature between about 400° F. and about 1100° F.

17. The process of claim 13 wherein said high permeability regions comprise a fracture network.

18. The process of claim 13 wherein said injection of said first light gas to create said gas cap and said injection of said second hot light gas to heat said formation are combined.

19. The process of claim 13 wherein said first light gas is injected prior to said injection of said second light gas.

20. The process of claim 13 wherein said at least one injection well and said at least one production well are a common well.

21. The process of claim 13 wherein said produced gas comprises at least a portion of said volatile component of said liquid hydrocarbons in said at least one low permeability region.

22. The process of claim 13 wherein a production tubing string is positioned in said at least one production well so as to allow production from a vertical zone below said gas/liquid interface.

23. The process of claim 22 wherein said process additionally comprises monitoring said gas/liquid interface to determine changes in the depth of said interface.

24. The process of claim 23 wherein the depth of said vertical zone is adjusted in response to changes in the depth of said interface.

25. The process of claim 23 wherein said depth of said interface is adjusted by changing the rate at which said hot gas is injected into said formation.

26. The process of claim 23 wherein said depth of said interface is adjusted by changing the rate at which said liquid and gas are produced.

27. The process of claim 13 wherein said at least one high permeability region comprises a fracture network, and said at least one low permeability region comprises matrix.

28. A process for recovering hydrocarbons from a subterranean hydrocarbon-bearing formation, the formation having at least one high permeability region and at least one low permeability region, the low permeability region and the high permeability region containing liquid hydrocarbons having a substantial fraction of volatile components, the process comprising:

decreasing the pressure of said formation, thereby creating a gas cap and a gas/liquid interface within the high permeability regions in the upper portion of the formation;

injecting a hot light gas into the formation via at least one injection well in fluid communication with the formation, thereby heating at least the upper portion of the formation; and producing liquid and gas from below the gas/liquid interface via at least one production well in fluid communication with the formation, thereby producing the liquid and gas at a rate sufficient to cause gas to cone near the at least one production well.

29. The process of claim 28 wherein said light gas is selected from the group consisting of steam, produced residue gas, flue gas, $CO_2$, $N_2$, and mixtures thereof.

30. The process of claim 28 wherein said heat is provided at a temperature between about 400° F. and about 1100° F.

31. The process of claim 28 wherein said high permeability regions comprise a fracture network.

32. The process of claim 28 wherein said at least one injection well and said at least one production well are a common well.

33. The process of claim 28 wherein said produced gas comprises at least a portion of said volatile component of said liquid hydrocarbons in said matrix blocks.

34. The process of claim 28 wherein a production tubing string is positioned in said at least one production well so as to allow production from a vertical zone below said gas/liquid interface.

35. The process of claim 34 wherein said process additionally comprises monitoring said gas/liquid interface to determine changes in the depth of said interface.

36. The process of claim 35 wherein the depth of said vertical zone is adjusted in response to changes in the depth of said interface.

37. The process of claim 35 wherein said depth of said interface is adjusted by changing the rate at which said hot gas is injected into said formation.

38. The process of claim 35 wherein said depth of said interface is adjusted by changing the rate at which said liquid and gas are produced.

39. The process of claim 28 wherein said at least one high permeability region comprises a fracture network, and said at least one low permeability region comprises matrix.

40. A process for recovering hydrocarbons from a subterranean hydrocarbon-bearing formation, the formation having substantially parallel first and second high permeability regions containing fluids and having an approximately vertical orientation, the high permeability regions separated by at least one low permeability matrix region containing liquid hydrocarbons having volatile components, the process comprising:

injecting a hot light gas into the formation via at least one injection well in fluid communication with the first high permeability region, thereby heating the at least one low permeability matrix region by thermal conduction to vaporize at least a portion of the volatile hydrocarbon components in the low permeability region and causing the vaporized components to flow from the matrix into the second high permeability region and segregate therein into liquid and gas layers separated by a gas/liquid interface; and producing hydrocarbons via at least one production well in fluid communication with the second high permeability region.

41. The process of claim 40 wherein said produced hydrocarbons comprise liquid and heavy gas and are produced from below the liquid/gas interface at a rate sufficient to cause heavy gas to cone near the at least one production well.

42. The process of claim 41 wherein said first high permeability region comprises an injection fracture network and said second high permeability region comprises a production fracture network.

43. The process of claim 42 wherein a secondary fracture system provides a poor degree of fluid communication between said injection and production fracture networks.

44. The process of claim 42 wherein said injection fracture network and said production fracture network are substantially in fluid isolation from each other.

45. The process of claim 40 wherein said light gas is selected from the group consisting of steam, produced residue gas, flue gas, $CO_2$, $N_2$, and mixtures thereof.

46. The process of claim 40 wherein said light gas is injected at a temperature between about 400° F. and about 1100° F.

47. The process of claim 40 wherein said produced hydrocarbons comprise at least a portion of said volatile components of said liquid hydrocarbons in said matrix.

48. The process of claim 40 wherein a production tubing string is positioned in said at least one production well so as to allow production from a vertical zone below said gas/liquid interface in said second high permeability region.

49. The process of claim 48 wherein said process additionally comprises monitoring said gas/liquid interface to determine changes in the depth of said interface.

50. The process of claim 49 wherein the depth of said vertical zone is adjusted in response to changes in the depth of said interface.

51. The process of claim 49 wherein said depth of said interface is adjusted by changing the rate at which said hydrocarbons are produced.

* * * * *